United States Patent [19]

Haes et al.

[11] 4,344,228

[45] Aug. 17, 1982

[54] SHAVING APPARATUS

[75] Inventors: Freddy Haes; Cornelis M. Reynhout; Guillaume M. P. G. Hermes, all of Eindhoven; Ebbe Boiten, Assen, all of Netherlands

[73] Assignee: U.S. Philips Corporation, New York, N.Y.

[21] Appl. No.: 164,614

[22] Filed: Jun. 30, 1980

[30] Foreign Application Priority Data

Jul. 3, 1979 [NL] Netherlands ..... 7905157

[51] Int. Cl.[3] ..... B26B 19/12

[52] U.S. Cl. ..... 30/43.9; 30/43.92

[58] Field of Search ..... 30/43.91, 43.92, 43.7, 30/43.8, 43.9

[56] References Cited

U.S. PATENT DOCUMENTS

| | | | |
|---|---|---|---|
| 2,337,623 | 12/1943 | Romao | 30/43.92 |
| 2,827,693 | 3/1958 | Kobler | 30/43.92 |
| 3,088,205 | 5/1963 | Ellis | 30/43.92 |
| 3,504,433 | 4/1970 | Futterer | 30/43.92 |
| 4,065,977 | 1/1978 | Buzzi et al. | 30/90 |

*Primary Examiner*—Nicholas P. Godici

*Attorney, Agent, or Firm*—Thomas A. Briody; William J. Streeter; Rolf E. Schneider

[57] ABSTRACT

There is provided a shaving apparatus comprising an external cutting element and an internal cutting element cooperating with and drivable relative to the external cutting element with a reciprocating movement. The internal cutting element is secured to the external cutting element by means of a connecting element which is flexible in the direction of driving and is rigid in directions extending substantially transversely of the direction of driving. The external cutting element is formed as a U-shaped part from a sheet material. The internal cutting element together with the connecting element constitutes a strip also made of a sheet material and positioned between the legs of the U-shaped part. The internal cutting element is situated at the end of the strip near the transverse portion of the U-shaped part; and the other end of the strip is connected to the legs of the U-shaped part.

5 Claims, 11 Drawing Figures

SHAVING APPARATUS

This invention relates to a shaving apparatus having an external first cutting element and an internal second cutting element which cooperates with said first cutting element, at least one of the cutting elements, preferably the internal second cutting element, being drivable with a reciprocating movement relative to the other cutting element.

Such a shaving apparatus is for example, known from U.S. Pat. No. 4,065,977. The first cutting element of this apparatus takes the form of a foil in which apertures are formed, the second drivable cutting element being urged against the inner side of the foil by means of springs. A disadvantage of this known construction is that owing to the forces occurring during shaving the foil may be deformed or the drivable cutting element may be pressed away from the foil, so that the distance between the two becomes too large for satisfactory cutting action.

The present invention, whose object it is to mitigate this drawback, provides a construction which is characterized in that the drivable cutting element is secured to the other cutting element by means of a connecting element which is flexible in the direction of driving and which is rigid in directions extending substantially transversely of the direction of driving.

A special embodiment is characterized in that the first cutting element together with two legs or limbs constitutes a U-shaped part of a sheet material and the second cutting element together with the connecting element constitutes a strip, also of a sheet material, which strip is arranged between the limbs of the U-shaped part, the second cutting element being situated at one end of the strip near the transverse portion of the U-shaped part and the strip being connected at its other end to the limbs of the U-shaped part.

Suitably the U-shaped part and the strip constitute a single or unitary component of a sheet material.

A particularly practical embodiment is characterized in that a plurality of combinations of said first and second cutting elements is provided, which combinations are spaced from each other by spacers and in combination with the spacers form a shaving unit.

A different embodiment is characterized in that a plurality of said first cutting elements constitutes a first cutting unit and a plurality of said second cutting elements constitutes a second cutting unit and the first cutting unit is coupled to the second cutting unit by at least one connecting element, which is flexible in the direction of driving and which is rigid in directions extending substantially transversely of the direction of driving.

Yet another embodiment is characterized in that a plurality of combinations of said first and second cutting elements is arranged in a circle and the drivable cutting elements are each provided with a part which is situated in the path of movement of the spokes of a rotatable wheel.

An embodiment which performs particularly effectively is characterized in that each drivable cutting element is provided with a cutting edge in combination with a hair-pulling edge which is situated in front of the cutting edge in the direction of driving and which is spaced further than the cutting edge from the corresponding other cutting element.

The invention will now be explained in connection with the accompanying drawings, in which.

Figure 7:
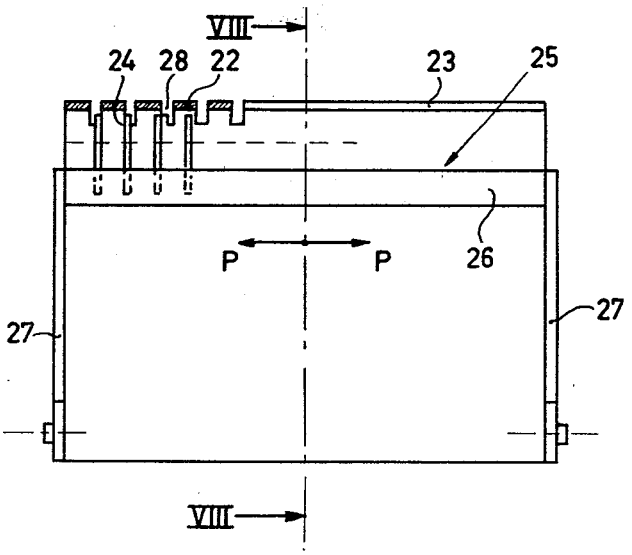

FIG. 7 in a schematic longitudinal section shows a different embodiment of the cutting elements.

Figure 8:
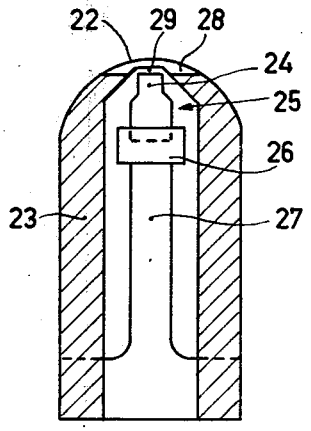

FIG. 8 is a cross-section taken on the line VIII—VIII in FIG. 7.

Figure 9:
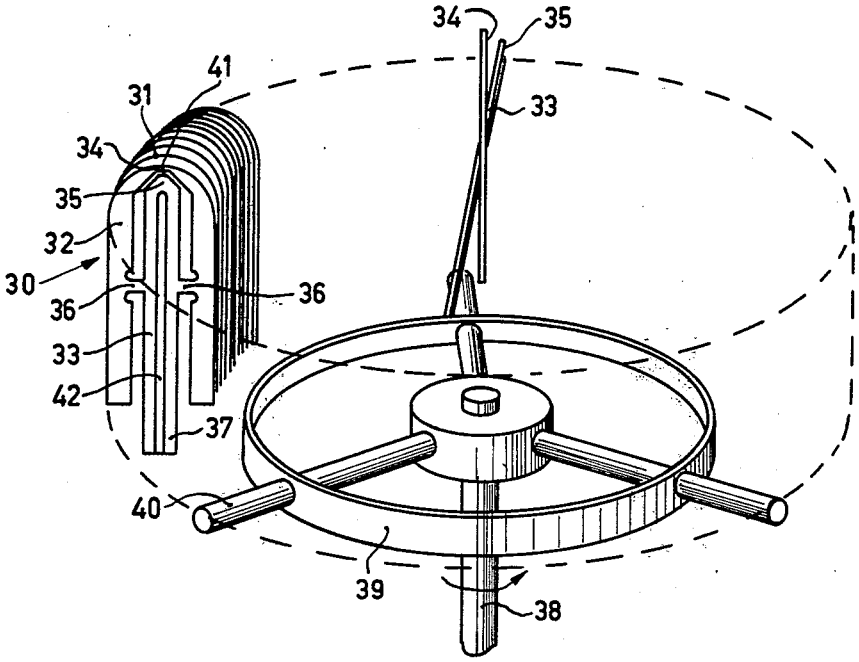

FIG. 9 schematically represents an embodiment with a rotating drive mechanism.

Figure 10:
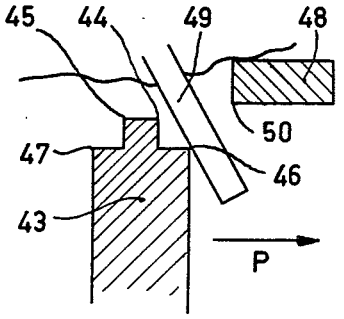
Figure 11:
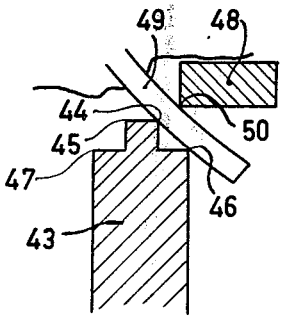

FIGS. 10 and 11 schematically represent still another embodiment of the cutting elements in sectional side view.

The apparatus of FIGS. 1 to 6 comprises a shaving unit 1 and a drive mechanism 2. This shaving unit and the drive mechanism are accommodated in a housing which is not shown for the sake of clarity and which is for example provided with an opening through which the shaving unit can be brought into contact with the skin to be shaved.

Figure 1:
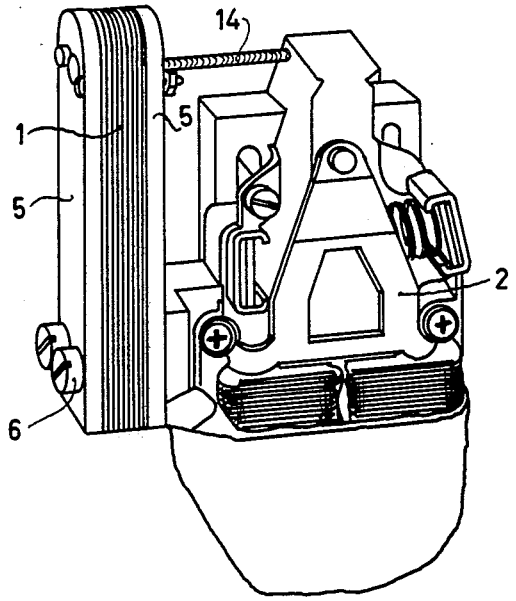
FIG. 1 is a perspective view of a shaving apparatus with a shaving unit and a drive means.
Figure 2:
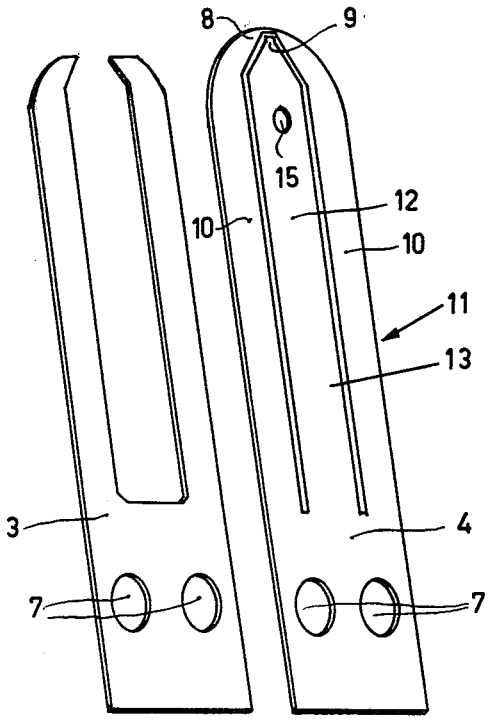
FIG. 2 shows on an enlarged scale two parts of the shaving unit in perspective.

The principal parts of the shaving unit are constituted by alternating elongate lamellae 3 and 4 of a sheet material (see FIG. 2). Several such lamellae are stacked against each other, a lamella 3 being interposed between every two adjacent lamellae 4, which lamella 3 constitutes a spacer to space the two adjacent lamellae 4 from each other. The assembly together with end plates 5 is clamped together by means of threaded bolts 6 which extend through aligned holes 7 in the end plates and the lamellae.

Figure 3:
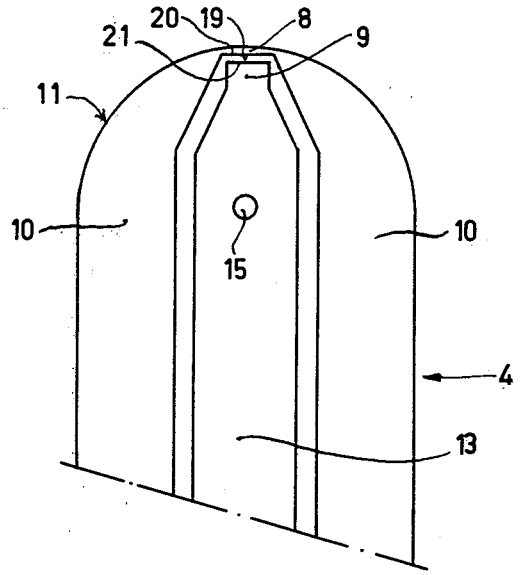
FIG. 3 is a detailed elevation on a further enlarged scale of a part of the shaving unit with the cutting elements.

At one end each lamella 4 is provided with a stationary external first cutting element 8 and a movable internal second cutting element 9 (see FIG. 3). The first cutting element 8 together with two legs or limbs 10 constitutes a U-shaped part 11. The second cutting element 9 in conjunction with a connecting element 12 constitutes a flexible strip 13 which is situated between the limbs of the U-shaped part 11. The U-shaped part 11 and the flexible strip 13 constitute a single component 4 of a sheet material. However, the strip 13 may alternatively be secured to the U-shaped part by welding or riveting or the like.

Figure 4:
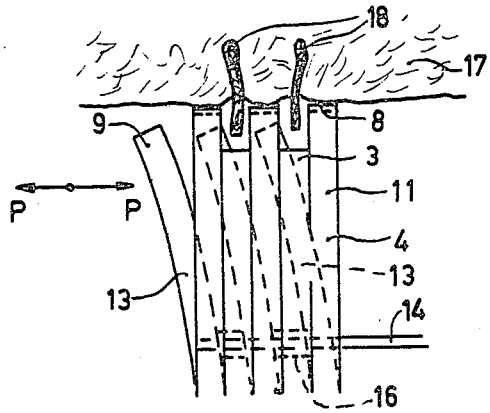
FIGS. 4, 5 and 6 show a detail of the shaving unit in side view in different positions of the cutting elements relative to each other and illustrate the operation of the apparatus.

The strips 13 of the shaving unit are coupled to the drive mechanism 2, namely a vibrator motor, by means of a spindle 14, so that the end portions of the strips 13 comprising the second cutting elements 9 can perform a substantially reciprocating movement as indicated by the arrows P in FIG. 4. The spindle 14 extends through openings 15 in the strips 13. Around the spindle 14 and between adjacent strips 13 ferrules 16 are arranged, so that the strips are also spaced from each other.

Each connecting element 12 in fact constitutes a leaf spring which is flexible in the directions of driving P but rigid in directions situated in the plane of the corresponding lamella 4, in particular in the longitudinal direction of the connecting element 12 itself.

Figure 5:
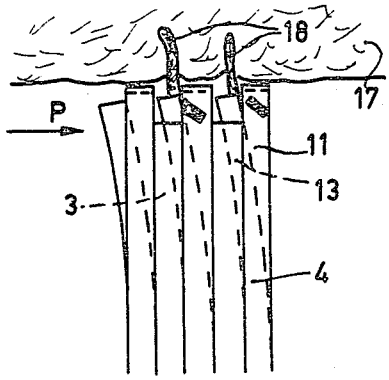
Figure 6:
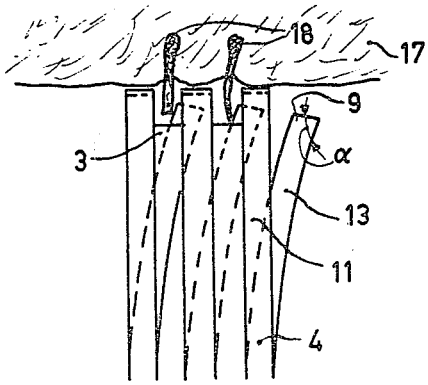

FIGS. 4 to 6 show in side view some lamellae 3 and 4 with the U-shaped parts 11 and the strips 13 in different positions relative to each other, whilst moreover a skin portion 17 with hairs 18 is shown. In the situation of FIG. 4 the strips 13 have a maximum deflection such that the end of the strip 13 of each lamella 4 with the cutting element 9 is located between the limbs of the U-shaped part 11 of an adjacent lamella 4. As a result of this the hairs 18 are caught between the U-shaped parts 11 of adjacent lamellae 4.

During the return movement P, as indicated in FIG. 5, the hairs are severed by the cutting edges 20 and 21 (FIG. 3) of the cutting elements 8 nd 9 respectively. Subsequently the strips 13 reach the other extreme position, as shown in FIG. 6, in which again hairs are caught between the U-shaped parts 11 of adjacent lamellae 4. Obviously, it is also possible that a hair is cut off by cooperation between two cutting elements 8 and 9 which do not belong to the same lamella 4. As an example, cutting element 9 of the extreme right-hand lamella of the three lamellae shown in FIGS. 4 to 6 may also cooperate with the cutting element 8 of the centre lamella 4.

At the instant of cutting (FIG. 5), forces occur whose components act on the strips 13 in a direction substantially perpendicular to the skin, i.e. in the longitudinal direction of the strips, and away from the cutting elements 8. Since each strip 13 and the associated U-shaped part 11 are secured to each other and the strips 13 and the limbs 10 have a high rigidity in the longitudinal direction, the width of the cutting gap 19, i.e. the distance between the cutting edges 20 and 21 (FIG. 3) of each pair of cutting elements 8 and 9 respectively does not change significantly. During manufacture this cutting gap 19 can be adjusted for optimum cutting properties of the apparatus.

As the cutting gap between the first and second cutting elements remains constant, the problem of wear as a result of mutual contact and a rise in temperature owing to friction of the cutting elements is also solved.

The cutting angle $\alpha$ of the cutting edge of each cutting element 9 as shown in FIG. 6 is 90°. By machining the cutting elements 9 it is also possible to use different cutting angles, generally smaller than 90°.

In the embodiment of FIGS. 7 and 8 a plurality of first cutting elements 22 is united to form a stationary cutting unit 23, whilst a plurality of second cutting elements 24 forms part of a movable cutting unit 25. The cutting unit 25 also comprises a bar 26 to which the cutting elements 24 are secured. The bar 26 is secured to the cutting unit 23 by means of resilient strips 27. The cutting unit 23 is constituted by a body of substantially U-shaped cross-section, in which the first cutting elements are formed by means of sawcuts 28.

By means of a vibrator motor, not shown, the cutting unit 25 is driven with a reciprocating movement relative to the cutting unit 23 in the directions P. The operation of this embodiment is otherwise identical to that of the embodiment of FIGS. 1 to 6. Owing to the rigidity in the longitudinal direction of the resilient strips 27 each cutting gap 29 will also remain practically constant during the operation of this embodiment.

In the embodiment of FIG. 9 lamellae 30 are arranged in a circle. Again these cutting lamellae 30 can be spaced from each other by spacing lamellae 31 of the same configuration as the lamellae 3 of FIG. 2. The lamellae 30 each comprise a U-shaped part 32 with a first cutting element 34 and a strip 33 with a second cutting element 35. The strip 33 is secured intermediate its ends to the U-shaped part 32 by connecting elements in the form of cross-pieces 36. The end 37 of the strip 33 remote from the cutting element 35 extends beyond the limbs of the U-shaped part 32.

This embodiment can be driven by means of an electric motor, not shown with a rotating spindle 38. To the spindle a wheel 39 with radically extending spokes 40 is secured. The ends 37 of the strips 33 are struck by the spokes 40 when the wheel 39 is driven, the strips 33 thereby being rotated about the axis of the cross-pieces 36. These cross-pieces are torsionally resilient and are therefore flexible in the direction of driving, but they are rigid in directions extending transversely of the direction of driving. When a spoke has passed a strip the strip springs back to its original position. The operation of the cutting elements is otherwise identical to that of the embodiment in accordance with FIGS. 1 to 6. As the angle of rotation of the strips 33 is only small, the movement of each cutting element 35 relative to the associated cutting element 34 may be considered a reciprocating movement.

In this case the cutting gap between the cutting edges of each pair of cutting elements 34 and 35 during cutting of a hair is again substantially equal in width to the cutting gap 41 between the cutting edges when no hair is being cut, owing to the high rigidity of the respective lamella 30 in the plane of the lamella itself.

In order to increase the rigidity each strip 33 is formed with a longitudinal rib 42.

FIGS. 10 and 11 relate to a special embodiment of the second driven cutting element, which may be used in the shaving units described above.

Each second cutting element 43 is provided on opposite sides with cutting edges 44 and 45 and with associated hair-pulling edges 46 and 47 respectively.

The hair-pulling edge 46 is situated in front of the cutting edge 44 in the direction of driving P and is moreover situated at a greater distance than the cutting edge 44 from the corresponding first cutting element 48.

During movement in the indicated direction P, first the hair-pulling edge 46 will meet a hair 49. The edge 46 will slightly penetrate the hair and pull it in the direction of movement P (FIG. 10). As a result of this the hair 49 is pulled up from the skin over some length. When the cutting edge 44 now reaches the hair a greater length of the hair 49 will be cut off (FIG. 11) by the cooperation of this cutting edge with the cutting edge 50 of the first cutting element 48 than would be cut off by the cutting edge of a second cutting element which is not preceded by a hair-pulling edge.

In the case moreover of the second cutting element 43 moving in a direction opposite to direction P the hair-pulling edge 47 and the associated cutting edge 45 operate in a similar way to that described above.

The shaving apparatuses with a constant cutting gap described in the foregoing are particularly suitable for use with cutting elements having contact edges as shown in FIGS. 10 and 11, because in that case there is no risk of the first and second cutting elements coming into contact with each other and the cutting edges 44, 45 being eroded by wear.

What is claimed is:

1. A shaving apparatus comprising an external cutting element; an internal cutting element cooperating with said external cutting element and being drivable with a reciprocating movement relative to the external cutting element; and a connecting element securing the internal cutting element to the external cutting element, said connecting element being flexible in the direction of driving and rigid in directions extending substantially transversely of the direction of driving; the external cutting element together with two legs constituting a U-shaped part of a sheet material and the internal cutting element together with the connecting element constituting a strip also made of a sheet material and positioned between the legs of the U-shaped part; the internal cutting element being situated at the end of the strip near the transverse portion of the U-shaped part and the other end of the strip being connected to the legs of the U-shaped part.

2. A shaving apparatus according to claim 1, in which the U-shaped part and the strip constitute a unitary component of a sheet material.

3. A shaving apparatus according to claim 1 or 2, which comprises a plurality of combinations of said external cutting element and said internal cutting element, and which includes spacers respectively separating adjacent combinations from each other to form a shaving unit.

4. A shaving apparatus according to claim 1 or 2, which comprises a plurality of combinations of said external cutting element and said internal cutting element, said combinations being arranged in a circle, each strip extending beyond the ends of the legs of its associated U-shaped part; and which includes a rotatable wheel provided with radially extending spokes so positioned that, as the wheel is rotated, each spoke successively contacts the extending portion of the respective strip.

5. A shaving apparatus according to claim 1, in which the internal cutting element is formed with a cutting edge and a hair-pulling edge arranged in front of the cutting edge in the direction of driving, said hair-pulling edge being spaced further than the cutting edge from the external cutting element.

* * * * *